US007305860B2

(12) United States Patent
Yang et al.

(10) Patent No.: US 7,305,860 B2
(45) Date of Patent: Dec. 11, 2007

(54) METHOD FOR TUBE FORMING

(75) Inventors: Wuhua Yang, Ann Arbor, MI (US); Michael L. Wenner, Oakland, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/554,153

(22) Filed: Oct. 30, 2006

(65) Prior Publication Data

US 2007/0101786 A1 May 10, 2007

Related U.S. Application Data

(60) Provisional application No. 60/736,148, filed on Nov. 10, 2005.

(51) Int. Cl.
*B21D 9/18* (2006.01)
*B21D 26/02* (2006.01)

(52) U.S. Cl. ..... 72/61; 72/62; 72/342.94; 72/370.06; 72/370.22; 72/370.24; 29/421.1

(58) Field of Classification Search ..... 72/60, 72/62, 342.94, 709, 370.06, 370.22, 370.24; 148/520, 570; 29/421.1
See application file for complete search history.

(56) References Cited

U.S. PATENT DOCUMENTS 5,992,197 A * 11/1999 Freeman et al. ..... 72/62
6,322,645 B1 * 11/2001 Dykstra et al. ..... 72/62
6,613,164 B2 * 9/2003 Dykstra et al. ..... 72/62
7,024,897 B2 * 4/2006 Pfaffmann et al. ..... 72/60

* cited by examiner

*Primary Examiner*—David B Jones

(57) ABSTRACT

A method is provided for forming a tube between a pair of dies. The tube is captured between a pair of dies having die surfaces constructed of an electrically non-conducting material defining a die cavity therein. The ends of the tube are sealed and electrical current is applied to the tube to induce electrical resistance heating of the tube. The interior of the tube is pressurized to expand the tube into the cavity to thereby form the heated tube.

19 Claims, 2 Drawing Sheets

METHOD FOR TUBE FORMING

This application claims the benefit of U.S. Provisional Application No. 60/736,148, filed Nov. 10, 2005, the contents of which is incorporated herein in its entirety.

FIELD OF THE INVENTION

The present invention relates to forming a tube by positioning the tube within a pair of dies and then pressurizing the interior of the tube to expand the tube into the shape of the die cavity.

BACKGROUND OF THE INVENTION

It is known to form a tube by positioning the tube between a pair of dies and then applying internal pressure to expand the tube into the shape of the die cavity. It is also known to heat a tube or other metal article that is to be formed in an oven in order to improve the formability of the tube.

SUMMARY OF THE INVENTION

A method is provided for forming a tube between a pair of dies. The tube is captured between a pair of dies having die surfaces constructed of an electrically non-conducting material. The ends of the tube are sealed and electrical current is applied to the tube while the tube is captured by the dies to induce electrical resistance heating of the tube. The interior of the tube is pressurized to expand the tube into the cavity to thereby form the heated tube.

Features and advantages of the present invention will become apparent from the detailed description provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE EXEMPLARY EMBODIMENTS

The following description of certain exemplary embodiments is merely exemplary in nature and is not intended to limit the invention, its application, or uses.

Figure 1:
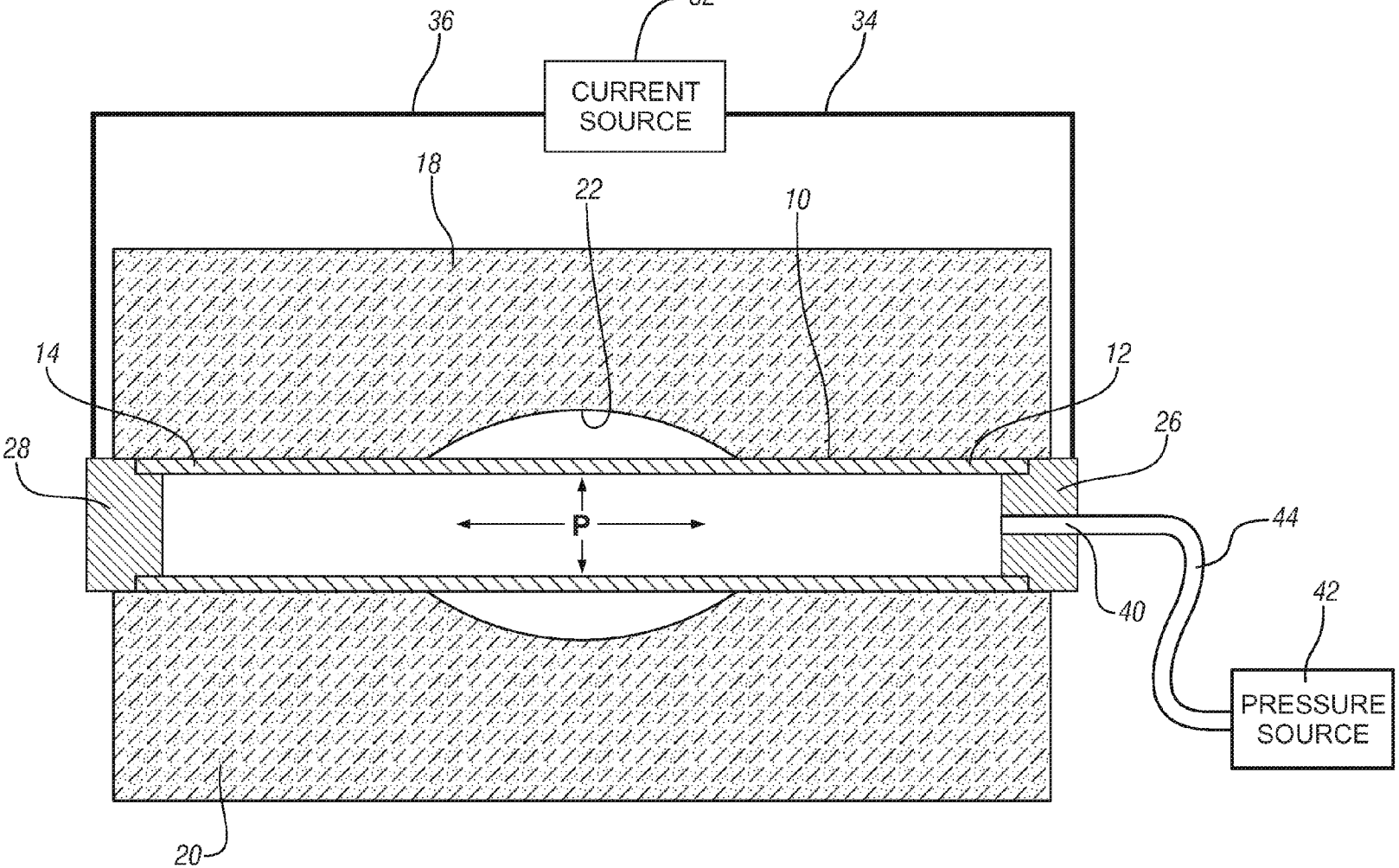
FIG. 1 is a section view showing a tube positioned between a pair of dies and electrodes sealing the ends of the tube.

Referring to FIG. 1, a metallic tube 10 has a right end 12 and a left end 14.

The tube 10 is captured between an upper die 18 and a lower die 20 that are formed of an electrically non-conductive material such as ceramic. The dies 18 and 20 define a cavity 22 that is larger in diameter than the diameter of the tube 10.

The right end 12 of the tube 10 is plugged by a seal assembly, more particularly an electrode 26 made of an electrically conductive material such as steel or copper. The electrode 26 sealingly engages with the tube 10 in a manner to form a pressure tight seal between the tube 10 and the electrode 26 and to create an electrically conductive connection between the electrode 26 and the tube 10.

The left end 14 of the tube 10 is plugged by a seal assembly, more particularly an electrode 28 made of an electrically conductive material such as steel or copper. The electrode 28 sealingly engages with the tube 10 in a manner to form a pressure tight seal between the tube 10 and the electrode 28 and to create an electrically conductive connection between the electrode 28 and the tube 10.

The electrodes 26 and 28 can be applied to the tube 10 either before or after the tube 10 is captured within the dies 18 and 20. A source of electric current 32 is connected to the electrode 26 by a cable 34 and connected to the electrode 28 by a cable 36. Electrode 26 has an inlet 40 that is connected to a pressure source 42 by a hose 44.

After the electrodes 26 and 28 are applied to the ends 12 and 14 of the tube 10, and after the tube 10 is captured within the dies 18 and 20, electrical current is applied to the electrodes 26 and 28. The electrical current may be either direct current or alternating current. The passage of electrical current between the electrodes induces electrical resistance heating of the tube 10. The ceramic material of the dies isolates the tube 10 from being grounded. The ceramic material will also thermally insulate the tube 10 from the conventional press that opens and closes the dies. The level of the electrical current and its time of duration are controlled to cause the desired degree of heating of the tube 10. Pressurized gas is introduced through inlet 40 that is provided in the electrode 26. The pressurized gas may be applied either prior to, during, or after the application of electrical current to heat the metallic tube 10 and causes the tube 10 to be expanded outwardly into conformance with the shape of the die cavity 22.

It will be understood and appreciated that the degree of heating of the tube will determine the magnitude of the improvement of the formability of the tube. As one example, we have determined by computer simulation that a tube of aluminum AA5754, and 600 mm. lengths, 40 mm. diameter, and 2 mm. wall thickness can be heated to a temperature of 250 degrees Centigrade in 11.7 seconds by applying a current of 10 kA. Or, if a current of 20 kA is applied to that tube, the tube will reach 250 degrees Centigrade in 2.98 seconds. A person of skill in process engineering will recognize that higher or lower temperatures may be selected in a particular application of this method, depending upon variables such as the pressure applied, the size of the tube, the size and shape of the cavity, and other variables.

Figure 2:
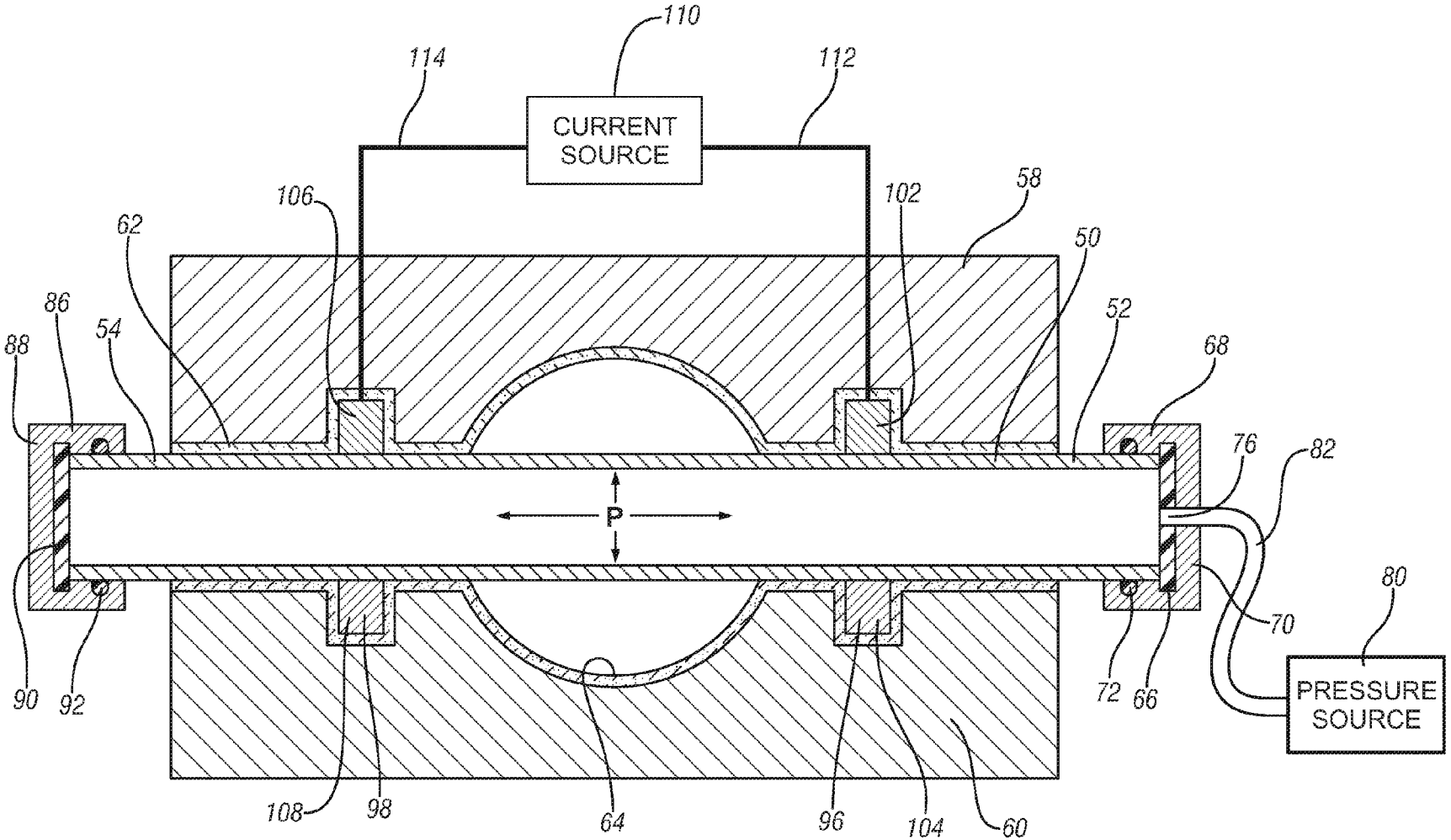
FIG. 2 is a section view similar to FIG. 1 but showing another embodiment in which electrodes are mounted within the dies and a seal assembly seals the ends of the tube.

Referring to FIG. 2, a metallic tube 50 has a right end 52 and a left end 54. The tube 50 is captured between an upper die 58 and a lower die 60. The dies 58 and 60 are of conventional metal construction but are lined with an insulating layer 62 formed of an electrically non-conductive material such as ceramic or polymer, or other dielectric material. The dies 58 and 60 define a cavity 64 that is larger in diameter than the diameter of the tube 50.

The right end 52 of the tube 50 is plugged by a seal assembly 68 that includes a metal cap 70, an end seal 66 and an O-ring outer seal 72. Metal cap 70 has an inlet 76 that is connected to a pressure source 80 by a hose 82. The left end 54 of the tube 50 is plugged by a seal assembly 86 that includes a metal cap 88, an end seal 90 and an O-ring outer seal 92. The seal assemblies 68 and 86 can be applied to the tube 50 either before or after the tube 50 is captured within the dies 58 and 60.

As seen in FIG. 2, a pair of split ring electrodes 96 and 98 are mounted within the upper die 58 and the lower die 60. The electrode 96 includes an upper electrode half 102 mounted in the upper die 58 and a lower electrode half 104 mounted in the lower die 60. Likewise the electrode 98 includes an upper electrode half 106 mounted in the upper die 58 and a lower electrode half 108 mounted in the lower die 60. Accordingly, when the dies 58 and 60 are closed around the tube 50, the electrodes 96 and 98 are closed into electrical contacting engagement with the tube 50. As shown in FIG. 2, the electrodes 96 and 98 can be located close to and on opposite sides of the cavity 64 into which the tube 50 is to be expanded.

A source of electric current 110 is connected to the electrode 96 by a cable 112 and connected to the electrode 98 by a cable 114.

After the tube 50 is captured within the dies 58 and 60, electrical current is applied to the electrodes 96 and 98. The electrical current may be either direct current or alternating current. The flow of electrical current between the electrodes 96 and 98 induces electrical resistance heating of the tube 10, particularly that part of the tube 50 that lies between the electrodes 96 and 98. Thus the heating is concentrated at that part of the tube wall that needs to be formed into the cavity and the ends of the tube and the seal assemblies are subject to less heat. The level of the electrical current and its time of duration are controlled to cause the desired degree of heating of the tube 10. Pressurized gas is introduced through inlet 76 of the seal assembly 68. The pressurized gas may be applied either prior to, during, or after the application of electrical current to heat the metallic tube 50. The heating of the tube 50 improves the formability of the tube 50 and the pressurized gas causes the tube to be expanded outwardly into conformance with the shape of the die cavity 64.

The foregoing description of the invention is merely exemplary in nature and, thus, variations thereof are intended to be within the scope of the invention.

Thus, for example, the dies may be constructed of an electrically non-conductive ceramic material or of other dielectric materials. Or the dies may be constructed of an electrically conductive material such as steel, but then lined with an electrically non-conductive material such as ceramic or polymer, so that the metallic tube is electrically insulated from the electrically conductive steel portion of the dies.

As an alternative to pressurizing the tube with pressurized gas, it may be desirable to use a pressurized fluid such as oil or water. In the case of using a pressurized fluid, the heating of the tube by electric resistance heating may be terminated prior to introducing the fluid to avoid shorting of the electric current through the fluid. The pressurized fluid may be heated, if desired, so that the introduction of the fluid will not unduly transfer heat away from the tube.

The end seal may serve as both an electrode and a seal, or an electrode separate from the seal may be directly applied to the tube, in which case the seal could include an elastomeric seal ring to both improve the sealing action between the seal and the tube, and also electrically insulate the seal from the tube. The seal assemblies can be applied to the tube ends either manually or by mounting the seal assemblies on hydraulic cylinders or other device for applying and removing the seal assemblies from the tube end.

The electrodes may be strategically placed upon the tube so as to concentrate the heating at that part of the tube that most needs to be heated to improve its formability. The electrodes may be in the form of a ring that surrounds the tube as in FIG. 2, or the electrodes may be sized and located in spaced apart positions to make a point of contact with the tube rather than surround the tube.

What is claimed is:

1. A method of forming a tube between a pair of dies, comprising:

capturing the tube between a pair of dies having die surfaces constructed of an electrically non-conducting material defining a die cavity therein;

sealing the ends of the tube;

applying electrical current directly to the tube while captured between the pair of dies to induce electrical resistance heating of the tube;

and pressurizing the interior of the tube to expand the tube into the die cavity to form the heated tube.

2. The method of claim 1 further comprising pressurizing the interior of the tube with steam.

3. The method of claim 1 further comprising pressurizing the interior of tube with heated fluid.

4. The method of claim 1 further comprising pressurizing the interior of the tube with heated gas.

5. The method of claim 1 further comprising the pair of dies being constructed of a dielectric material.

6. The method of claim 1 further comprising the pair of dies being constructed of an electrically conductive material and having the die cavity lined with a dielectric material.

7. The method of claim 1 further comprising sealing the ends of the tube with a seal constructed of an electrically conductive material that contacts with the tube and then applying the electric current to the seal.

8. The method of claim 1 further comprising sealing the ends of the tube with a seal that electrically insulates the tube from the seal and then applying the electrical current to the tube by applying first and second electrodes to the tube and applying the electric current to the tube via the pair of electrodes.

9. The method of claim 8 further comprising mounting first and second electrodes within the dies so that the electrodes will contact with the tube when the tube is captured within the dies, and applying the electric current to the electrodes.

10. The method of claim 9 further comprising mounting the electrodes on opposed sides of that portion of the tube that is to be expanded into the die cavity.

11. A method of forming a tube between a pair of dies, comprising:

capturing the tube between a pair of dies having die surfaces constructed of an electrically non-conducting material and defining a die cavity therein of the of the intended shape of the formed tube;

sealing the ends of the tube with a pair of electrodes;

applying electrical current to the electrodes to induce electrical resistance heating of the tube;

and pressurizing the interior of the tube to expand the tube into the cavity to form the heated tube.

12. The method of claim 11 further comprising the pair of dies being constructed of a dielectric material.

13. The method of claim 11 further comprising the pair of dies being constructed of an electrically conductive material and having the die cavity lined with a dielectric material.

14. A method of forming a tube between a pair of dies, comprising:

capturing the tube between a pair of dies having die surfaces constructed of an electrically non-conducting material, said dies defining a die cavity therein of the intended shape of the formed tube and having mounted therein a pair of electrodes that contact with the tube when the tube is captured within the pair dies;

sealing the ends of the tube;

applying electrical current to the electrodes while the tube is captured between the pair of dies to induce electrical resistance heating of the tube;

and pressurizing the interior of the tube to expand the tube into the cavity to form the heated tube.

15. The method of claim 14 further comprising each of said pair of electrodes being a split ring surrounding the tube and having a first portion of the split ring mounted in one of the pair of dies and a second portion of the split ring mounted in the other of the pair of dies.

16. The method of claim 14 further comprising mounting the electrodes on opposed sides of that portion of the tube that is to be expanded into the die cavity.

17. The method of claim 14 further comprising pressurizing the interior of the tube with steam.

18. The method of claim 14 further comprising pressurizing the interior of tube with heated fluid.

19. The method of claim 14 further comprising pressurizing the interior of the tube with heated gas.

* * * * *